United States Patent [19]

Hayashi

[11] Patent Number: 4,690,399

[45] Date of Patent: Sep. 1, 1987

[54] FLEXIBLE DUMBBELL

[75] Inventor: Sadao Hayashi, Nagoya, Japan

[73] Assignee: Asahi Gomu Kako Kabushiki Kaisha, Aichi, Japan

[21] Appl. No.: 590,305

[22] Filed: Mar. 16, 1984

[30] Foreign Application Priority Data

Mar. 16, 1983 [JP] Japan ..... 58-38220[U]
Nov. 2, 1983 [JP] Japan ..... 58-206636
Jan. 21, 1984 [JP] Japan ..... 59-9154

[51] Int. Cl.[4] ..... A63B 21/11

[52] U.S. Cl. ..... 272/122; 272/68; 272/117

[58] Field of Search ..... 272/67, 68, 122, 123, 272/124, 125, 93, 135, 143, 117, 116, 119; 74/558, 558.9, 557.9; 273/75, 84

[56] References Cited

U.S. PATENT DOCUMENTS

| | | | |
|---|---|---|---|
| 295,429 | 3/1884 | Reach | 272/124 |
| 558,320 | 4/1896 | Solberg | 272/124 |
| 897,201 | 8/1908 | Gannon | 273/84 |
| 1,564,957 | 12/1925 | Heyn | 74/558.5 |
| 1,918,142 | 7/1933 | Smith | 272/122 |
| 3,016,763 | 1/1962 | Albert | 74/558.5 X |
| 4,218,057 | 8/1980 | Wilson | 272/117 |
| 4,239,211 | 12/1980 | Wilkerson | 272/119 |
| 4,240,624 | 12/1980 | Wilson | 272/68 |
| 4,351,526 | 9/1982 | Schwartz | 272/122 |

FOREIGN PATENT DOCUMENTS

| | | | |
|---|---|---|---|
| 550961 | 2/1943 | United Kingdom | 272/68 |

*Primary Examiner*—Richard J. Apley
*Assistant Examiner*—Robert W. Bahr
*Attorney, Agent, or Firm*—Armstrong, Nikaido, Marmelstein & Kubovcik

[57] ABSTRACT

A flexible dumbbell comprises a cylindrical body of elastic material such as rubber formed in predetermined length and diameter suitable for various kinds of physical exercises or running, and a flexible core element of predetermined weight suitable for a user's physique contained within the cylindrical body to provide radial resiliency of the dumbbell. The cylindrical body is closed in an appropriate manner at the opposite ends thereof to retain the core element in place.

5 Claims, 5 Drawing Figures

FLEXIBLE DUMBBELL

BACKGROUND OF THE INVENTION

The present invention relates to a dumbbell for use in various kinds of sports, and more particularly to a flexible dumbbell suitable for use in physical exercises, running or the like.

A conventional dumbbell is made of cast iron, which is used by grasping the central portion thereof to train muscles of a wrist, an arm, a shoulder and the like. In case a user grasps one end of the dumbbell and swings its other end at a constant rhythm in a vertical direction, he will feel a pain at his carpal bones due to excessive weight of the dumbbell acting on his arm joint. In case a user grasps the central portion of the dumbbell and swings it in running, the weight load of the dumbbell acting on his wrist, arm and shoulder will increase due to his feet impacting on the ground to cause muscle binding of his swing arm. For these reasons, the dumbbell of cast iron is unsuitable for use in physical exercises, running and the like. Furthermore, the dumbbell of cast iron will injure the user's hand or an adjacent instrument in its careless use, and in winter the user will hesitate to use the dumbbell of cast iron because of a cold feel.

SUMMARY OF THE INVENTION

It is, therefore, the primary object of the present invention to provide a flexible dumbbell suitable for use in various kinds of physical exercises, running and the like and in its use capable of effecting appropriate shock absorption and excitement on the user's wrist, arm and shoulder.

Another object of the present invention is to provide a flexible dumbbell which is adjustable in weight suitable for user's physique in the same size.

According to the present invention, the foregoing objects are accomplished by providing a flexible dumbbell which comprises a cylindrical body of elastic material such as rubber formed in predetermined length and diameter suitable for various kinds of physical exercises, a flexible core element of predetermined weight suitable for a user's physique contained within the cylindrical body to provide radial resiliency of the dumbbell, and means for closing the opposite ends of the cylindrical body to retain the core element in place. It is preferable that the flexible core element consists of a number of metallic plates assembled longitudinally in a predetermined length within the cylindrical body. Alternatively, the flexible core element may be a single molded core element of rubber mixed therein with an amount of metallic powder. The flexible dumbbell may be modified in the form of a flexible dumbbell which comprises a cylindrical body of elastic material such as rubber formed in a piece with a pair of end walls, a flexible core element of predetermined weight contained within the cylindrical body and retained in place by engagement at its opposite ends with the end walls of the cylindrical body.

BRIEF DESCRIPTION OF THE DRAWINGS

Further and more specific objects, features and advantages of the present invention and the manner in which the invention is carried into practice are made apparent in the following detailed description wherein reference is made to the accompanying drawings, in which.

DETAILED DESCRIPTION OF THE PREFERRED EMBODIMENTS

Figure 1:
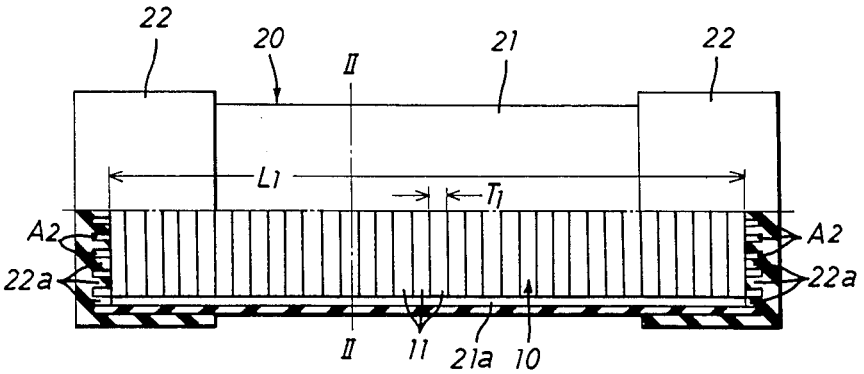
FIG. 1 is a partly broken sectional view of a flexible dumbbell in accordance with the present invention.
Figure 2:
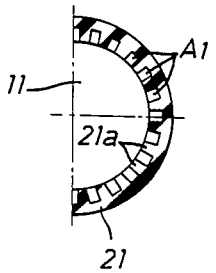
FIG. 2 is a partly cross-sectional view taken along line II—II in FIG. 1.

Referring now to the drawings, FIG. 1 illustrates a flexible dumbbell 20 which comprises a cylindrical body 21 of elastic material such as rubber, a core element 10 of predetermined weight contained within the cylindrical body 21, and a pair of end caps 22, 22 secured to the opposite ends of cylindrical body 21. The core element 10 consists of a number of iron disks 11 each of which has a predetermined thickness $T_1$. The iron disks 11 are assembled longitudinally in a predetermined length $L_1$ and radially displaceable in the cylindrical body 21 to effect an appropriate resiliency of the dumbbell 20. As can be well seen in FIG. 2, the cylindrical body 21 is formed at its inner wall with longitudinal ribs 21*a* which are circumferentially equi-spaced to provide first air gaps $A_1$ between the outer periphery of the core element assembly 10 and the inner periphery of cylindrical body 21. Each of end caps 22 is made of relatively hard rubber and is formed at its inner end wall with annular ribs 22*a* which are concentrically arranged to provide second air gaps $A_2$ at each end of the core element 10.

In such a construction as described above, the total weight of the flexible dumbbell 20 can be adjusted by replacement of the core element 10 with another core element assembly each disk of which is different in weight from the iron disk 11. For example, in the case that heavy metallic disks are adapted to the core element 10, the flexible dumbbell 20 is provided as a heavy dumbbell in the same size. When the flexible dumbbell is grasped by a user at its one end or central portion and swung up and down, the disks 11 of core element 10 displace slightly in a radial direction to cause appropriate flexure of the dumbbell 20 at its other end or opposite ends. This effects appropriate resiliency and shock absorption on the user's wrist. In use of the flexible dumbbell 20, the elasticity of cylindrical body 21 is useful to eliminate a feel of cold to the user in winter and to prevent an adjacent instrument from damage caused by abutment with the dumbbell 20. Furthermore, the provision of the air gaps $A_1$ and $A_2$ in the dumbbell 20 is useful to enhance the advantageous effects described above.

Figure 3:
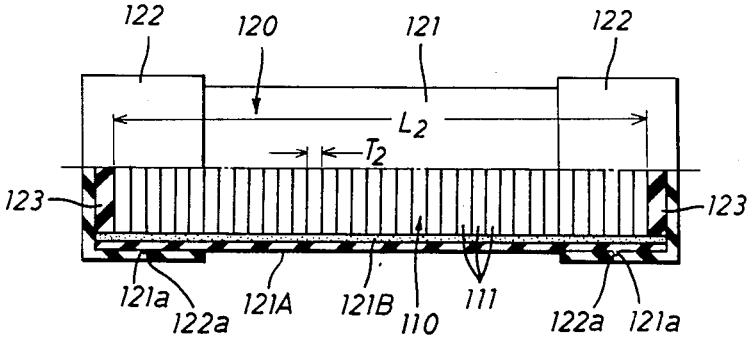
FIG. 3 is a partly broken sectional view of a modification of the flexible dumbbell of FIG. 1.

In FIG. 3 there is illustrated a modification 120 of the flexible dumbbell which comprises a cylindrical body assembly 121 and a flexible core element 110 contained within the cylindrical body assembly 121. The core element assembly 110 consists of a number of lead disks 111 each of which has a predetermined thickness $T_2$. The lead disks 111 are assembled longitudinally in a predetermined length $L_2$ and radially displaceable in the cylindrical body assembly 121 to provide an appropriate resiliency of the dumbbell 120. The cylindrical body assembly 121 is closed by a pair of end caps 122, 122 adhered to the opposite ends thereof. The cylindrical body assembly 121 includes an outer cylindrical member 121A of rubber and an inner cylindrical member 121B of sponge rubber. The outer cylindrical member 121A is formed at the opposite end portions thereof with a pair of annular projections 121*a*, 121*a*, while each of end caps 122, 122 is made of relatively hard rubber and formed at its inner wall with an annular recess 122*a* which is coupled with each annular projection 121*a* of cylindrical body 121. Furthermore, a soft rubber disk 123 is interposed between each inner wall of end caps 122, 122 and each end of the core element 110. In such a construction of the dumbbell 120, the inner cylindrical member 121B and the soft rubber disks 123 are useful to provide advantageous effects substantially as same as those in the dumbbell 20 of FIG. 1, and the lead disks 111 heavier than the iron disks 11 are adapted to form the dumbbell 120 in a smaller size.

Figure 4:
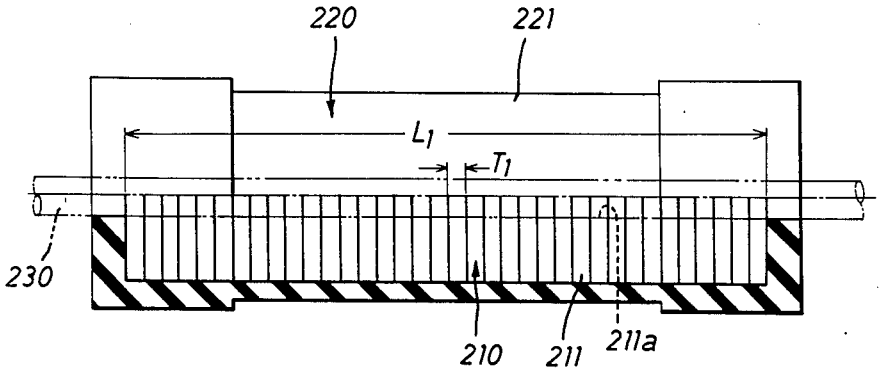
FIG. 4 is a partly broken sectional view of another modification of the flexible dumbbell of FIG. 1.

FIG. 4 illustrates another modification 220 of the flexible dumbbell which comprises a flexible core element 210 contained within a single cylindrical body 221 of elastic material such as rubber. The core element 210 consists of a number of iron disks 211 each of which has the same thickness $T_1$ as that of disk 11 in the dumbbell 20 of FIG. 1. The iron disks 211 are assembled longitudinally in the same length $L_1$ as that of the core element 10 in the dumbbell 20 and radially displaceable in the cylindrical body 221. In this modification, the disks 211 are respectively formed with a central hole 211*a* through which a core rod 230 is inserted during the process of molding the cylindrical body 220. The core rod 230 is previously inserted into the central holes 211*a* of disks 211 in an appropriate manner and positioned in a molding die (not shown). Subsequently, an amount of raw rubber material is put into the molding die and sulfurized, and thereafter the core rod 230 is drawn out of the molding die to complete the dumbbell 220. In such a construction described above, the iron disks 211 with central through holes 211*a* are adapted to form the dumbbell 220 in light weight but yet in the same size as that of the dumbbell 20 of FIG. 1.

In the actual practices of the present invention, the cylindrical body 21, 121 or 221 may be formed at its outer periphery with nonskid treatments such as straight, mesh or bias pattern ridges, and the metallic disks 11, 111 or 211 may be replaced with multiangular plates of different thickness or weight. The metallic core element 10, 110 or 210 may be also replaced with a predetermined amount of metallic particle and/or powder. In the actual practices of the dumbbell 20 of FIG. 1, the iron disks 11 located at an intermediate portion of the dumbbell may be replaced with disks of wood, synthetic resin, light weight metal or the like, while the iron disks 11 located at the opposite end portions of the dumbbell may be replaced with a pair of heavy metallic blocks. Alternatively, the iron disks 11 located at the intermediate portion of the dumbbell may be replaced with an amount of sand, light weight metallic particle or powder, while the iron disks 11 located at the opposite end portions of the dumbbell may be replaced with heavy metallic disks such as lead disks. It is further noted that the cylindrical body may be modified in its peripheral wall thickness and its outer configuration to enhance the design of the dumbbell.

Figure 5:
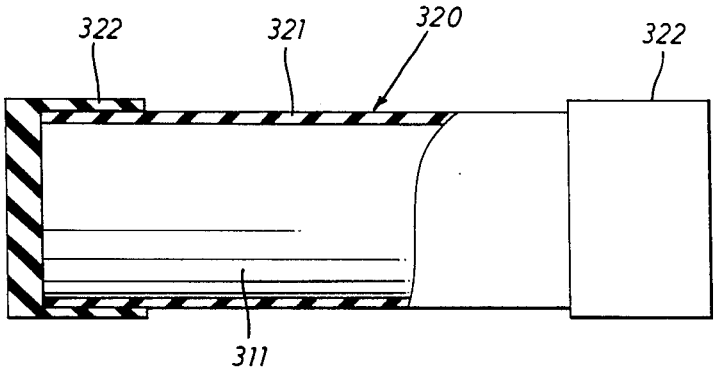
FIG. 5 is partly broken sectional view of another embodiment of a flexible dumbbell in accordance with the present invention.

In FIG. 5 there is illustrated another flexible dumbbell in accordance with the present invention which comprises a single molded flexible core element 320 contained within a flexible cylindrical body 321 which is provided at the opposite ends thereof with a pair of end caps 322 adhered thereto. The single molded flexible core element 320 is made of rubber mixed therein with an amount of heavy metallic powder, and the cylindrical body 321 is made of elastic material such as rubber. The end caps 322 are also made of soft synthetic resin. The cylindrical body 321 has a circular cross-section, and its length and diameter are respectively determined in appropriate dimension for use in physical exercises or running. Preferably, the heavy metallic powder is selected from lead monoxide (PbO), lead red ($Pb_3O_4$) or barium sulfate ($BaSO_4$). During the process of manufacturing the flexible core element 320, a predetermined amount of raw rubber material is mixed therein with an amount of the heavy metallic powder (PbO, $Pb_3O_4$or $BaSO_4$) and is sulfurized in a molding die. In this instance, the maximum amount of the heavy metallic powder mixed in the raw rubber material should be determined to obtain appropriate flexibility of the core element 310. For example, in manufacturing of a flexible core element of approximately 26 cm in length, 3.6 cm in diameter and 260 ml in volume, the maximum amount of the heavy metallic powder has been determined to be 52% in volume ratio. In use of lead monoxide (PbO), a flexible core element of 1.6 kg in weight has been obtained, and in use of barium sulfate ($BaSO_4$), a flexible core element of 1.0 kg has been obtained.

From the above description, it will be understood that a flexible core element of different weight in the same size can be manufactured by selection of kinds of the heavy metallic powder and its amount. That is to say, lead monoxide is useful to obtain a flexible core element of maximum weight, and barium sulfate is useful to obtain a flexible core element of minimum weight. Additionally, the raw rubber material for the flexible core element may be replaced with thermoplastic elastomer . In use of thermoplastic elastomer, the core element can be formed by injection molding or extrusion molding without any sulfurizing process.

Having now fully set forth preferred embodiments of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A flexible dumbbell comprising:

a cylindrical body of elastic material such as rubber formed in predetermined length and diameter suitable for use in various kinds of physical exercises;

a flexible core element of predetermined weight suitable for a user's physique contained within said cylindrical body and cooperable with said cylindrical body to provide radial resiliency of said dumbbell; and closure means for closing the opposite ends of said cylindrical body and for retaining said core element in place by engagement therewith;

wherein said closure means comprises a pair of end caps secured to the opposite ends of said cylindrical body, each of said end caps being made of hard synthetic resin and formed at its inner wall with a plurality of annular ribs which are concentrically arranged to provide air gaps at each end of said core element.

2. A flexible dumbbell as set forth in claim 1, wherein said cylindrical body of elastic material is formed at its inner wall with a plurality of longitudinal ribs which are circumferentially equi-spaced to provide air gaps between the outer periphery of said core element and the inner periphery of said cylindrical body.

3. A flexible dumbbell as set forth in claim 1, wherein said flexible core element is composed of a number of metallic plates assembled side-by-side in contact with each other longitudinally of said cylindrical body in a predetermined length and radially displaceable in said cylindrical body to provide radial resiliency of said dumbbell.

4. A flexible dumbbell as set forth in claim 3, wherein said cylindrical body has a circular cross-section, and said metallic plates have circular cross-sections.

5. A flexible dumbbell as set forth in claim 1, wherein said flexible core element includes a radially flexible light weight object located in an intermediate portion of said cylindrical body, and a pair of heavy weight objects located in the opposite end portions of said cylindrical body, and wherein said light weight object is composed of a plurality of light metallic disks assembled side-by-side in contact with each other longitudinally of said cylindrical body in a predetermined length and radially displaceable in the intermediate portion of said cylindrical body, and each of said heavy weight objects is composed of a plurality of heavy metallic disks assemble side-by-side in contact with each other longitudinally of said cylindrical body in a predetermined length and radially displaceable in each end portion of said cylindrical body.

* * * * *